US010066807B2

(12) United States Patent
Clauss et al.

(10) Patent No.: US 10,066,807 B2
(45) Date of Patent: Sep. 4, 2018

(54) FAçADE LAMP

(71) Applicant: ZUMTOBEL LIGHTING GMBH, Dornbirn (AT)

(72) Inventors: Bernd Clauss, Feldkirch (AT); Norbert Peter, Hohenems (AT); Stefan Schwarzmann, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 14/765,719

(22) PCT Filed: Feb. 7, 2014

(86) PCT No.: PCT/EP2014/052445
§ 371 (c)(1),
(2) Date: Aug. 4, 2015

(87) PCT Pub. No.: WO2014/122270
PCT Pub. Date: Aug. 14, 2014

(65) Prior Publication Data

US 2015/0369448 A1 Dec. 24, 2015

(30) Foreign Application Priority Data

Feb. 8, 2013 (DE) ..... 20 2013 100 577 U

(51) Int. Cl.
*F21S 8/02* (2006.01)
*F21V 5/00* (2018.01)
(Continued)

(52) U.S. Cl.
CPC ..... *F21V 5/007* (2013.01); *F21S 8/02* (2013.01); *F21V 5/02* (2013.01); *F21V 17/101* (2013.01);
(Continued)

(58) Field of Classification Search
CPC ..... F21V 5/007; F21V 17/101; F21V 21/044; F21V 21/047; F21V 25/10; F21V 21/02; F21W 2131/107; F21S 8/033
See application file for complete search history.

(56) References Cited

U.S. PATENT DOCUMENTS 4,954,932 A * 9/1990 Isenga ..... B63B 45/02 114/343
5,379,199 A * 1/1995 Hirshenhorn ..... F21S 8/024 362/147
(Continued)

FOREIGN PATENT DOCUMENTS

AT 12903 1/2013
CN 101725895 6/2010
(Continued)

OTHER PUBLICATIONS

International Search Report for PCT/EP2014/052445, English translation attached to original, Both completed by the European Patent Office on May 6, 2014, 8 Pages.
(Continued)

*Primary Examiner* — Julie Bannan
(74) *Attorney, Agent, or Firm* — Brooks Kushman P.C.

(57) ABSTRACT

A lamp for arranging in a façade construction having a pot-like housing or a carrier element, in particular a circuit board, having LEDs arranged therein or thereon, an optical unit associated with the LEDs, and a transparent cover, which together with the housing or the carrier element encloses the LEDs, wherein the optical unit is an integral component of the cover and the cover is adhesively bonded to the housing or to the carrier element.

10 Claims, 4 Drawing Sheets

(51) Int. Cl.

| | |
|---|---|
| ***F21V 31/00*** | (2006.01) |
| ***F21V 33/00*** | (2006.01) |
| ***F21V 17/10*** | (2006.01) |
| ***F21V 21/04*** | (2006.01) |
| ***F21V 5/02*** | (2006.01) |
| *F21V 25/10* | (2006.01) |
| *F21W 131/107* | (2006.01) |
| *F21Y 103/10* | (2016.01) |
| *F21Y 115/10* | (2016.01) |

(52) U.S. Cl.
CPC ..... *F21V 21/044* (2013.01); *F21V 31/005* (2013.01); *F21V 33/006* (2013.01); *F21V 25/10* (2013.01); *F21W 2131/107* (2013.01); *F21Y 2103/10* (2016.08); *F21Y 2115/10* (2016.08)

(56) References Cited

U.S. PATENT DOCUMENTS

| | | | | |
|---|---|---|---|---|
| 6,027,280 | A * | 2/2000 | Conners | E01C 17/00 362/153.1 |
| 6,030,104 | A * | 2/2000 | Shu | B60Q 1/32 362/191 |
| 6,174,067 | B1 * | 1/2001 | Thrasher | F21V 31/00 362/101 |
| 6,561,690 | B2 * | 5/2003 | Balestriero | F21V 29/87 257/E25.02 |
| 6,976,765 | B2 * | 12/2005 | Helenowski | F21S 8/024 362/147 |
| 7,812,550 | B2 * | 10/2010 | Harmgardt | H05B 33/0803 315/246 |
| 2004/0120141 | A1 * | 6/2004 | Beadle | F21S 8/024 362/147 |
| 2005/0024856 | A1 | 2/2005 | Helenowski | |
| 2005/0225966 | A1 * | 10/2005 | Hartmann, Jr. | F21S 8/02 362/147 |
| 2007/0139913 | A1 * | 6/2007 | Savage | B63B 45/02 362/101 |
| 2008/0043466 | A1 * | 2/2008 | Chakmakjian | F21V 5/007 362/237 |
| 2010/0246176 | A1 * | 9/2010 | Shyu | F21V 5/007 362/235 |
| 2011/0110097 | A1 * | 5/2011 | Fu | F21V 5/04 362/296.01 |
| 2012/0032612 | A1 | 2/2012 | Antony et al. | |
| 2013/0049049 | A1 * | 2/2013 | Choi | H01L 33/486 257/98 |
| 2013/0077307 | A1 * | 3/2013 | Yamamoto | F21S 8/026 362/244 |
| 2013/0141908 | A1 * | 6/2013 | Rodriguez | F21V 5/007 362/240 |
| 2014/0185289 | A1 | 7/2014 | Clauss et al. | |

FOREIGN PATENT DOCUMENTS

| | | |
|---|---|---|
| CN | 102352975 | 2/2012 |
| CN | 202209611 | 5/2012 |
| DE | 7029416 | 3/1971 |
| DE | 20307610 | 9/2003 |
| DE | 102004001940 | 8/2005 |
| DE | 202008005048 | 7/2008 |
| DE | 202011003261 | 4/2011 |
| DE | 202011051525 | 1/2012 |
| DE | 102011012653 | 8/2012 |
| GB | 2419935 | 5/2006 |
| GB | 2449179 | 11/2008 |
| WO | 2006094346 | 9/2006 |

OTHER PUBLICATIONS

German Search Report for German Application No. DE 202013100577.0, Completed by the German Patent Office, Dated Dec. 18, 2013, 8 Pages.

* cited by examiner

FAçADE LAMP

CROSS-REFERENCE TO RELATED APPLICATION

This application is the U.S. national phase of PCT Application No. PCT/EP14/052445 filed on Feb. 7, 2014, which claims priority to DE Patent Application No. 20 2013 100 577.0 filed on Feb. 8, 2013, the disclosures of which are incorporated in their entirety by reference herein.

The present invention relates to a lamp which is provided to be arranged on or in the façade of a building and has a plurality of LEDs arranged on a circuit board as light sources.

Façade lamps of this type are often used in the profile elements of a façade construction in order to illuminate a specific region of the façade or to achieve optical effects on the outer surface of the building. A preferred positioning of such lamps exists, for example, in the area of so-called window soffits, in order specifically to emphasize the region around the corresponding window optically.

On account of the space which is available, there is a desire here for the lamps to be configured as compactly as possible. This represents a problem, in particular when, firstly, use is made of light sources which themselves generate a relatively great deal of heat during operation and, secondly, the lamps are located in an environment in which high temperature differences can occur during operation as a result of external influences. However, such temperature differences in the environment can occur in particular in the aforementioned façade lamps, since, depending on the weather and sun's position, the temperatures can fluctuate very highly as a result of the differences in the solar irradiation resulting here. If LEDs are additionally used as light sources, the lamp must be designed by means of special measures in such a way that overheating of the LEDs during operation, and therefore corresponding damage, are prevented.

A further problem when using lamps in building façades is that the penetration of liquids is to be prevented. Firstly, of course, the lamp itself should be designed to be watertight since, in particular in the case of an arrangement in the external region of the building, there is always the risk that the lamp will be surrounded by liquid or at least high atmospheric humidity. In addition, in the case of an arrangement in the interior of a building, that is to say for example in the internal region of the window soffit, there is the risk that, for example when plastering the façade, the lamp and the corresponding profile of the façade construction will be exposed to liquids. While, in the case of profile elements facing the outer region of the building, it must in any case generally be assumed that water can enter the profile elements, this is preferably to be prevented in the profile elements facing the inner region, i.e. it is furthermore also necessary to take care that no liquids can penetrate via the mounting openings for the lamps that are provided in the profile elements of the façade.

The present invention is therefore based on the object of specifying lamps for arranging in a façade construction which, firstly, are configured sufficiently compactly with regard to the intended application and, secondly, are reliably secured against the penetration of liquids into the lamp itself or the profile elements of the façade construction that are provided for holding the lamp.

The object is achieved by a lamp as specified in the independent claims 1 and 4. Advantageous developments of the invention are the subject matter of the dependent claims.

A first aspect of the invention relates to measures with the aid of which the lamp itself is secured against the penetration of liquids. At the same time, as already mentioned, the lamp is intended to have a compact design and a light emission characteristic suitable for the purpose in view of the envisaged arrangement in a façade construction. To this end, the invention provides for the lamp to comprise a pot-like housing or a carrier element, for example a circuit board, in or on which LEDs are arranged. The LEDs are assigned an optical unit and a transparent cover which, together with the housing or the carrier element, encloses the LEDs, wherein the optical unit is an integral component of the cover and the cover is adhesively bonded to the housing or to the carrier element.

The first aspect of the present invention therefore proposes a lamp for arranging in a façade construction which has a pot-like housing or a carrier element, in or on which LEDs are arranged, wherein the lamp further has an optical unit assigned to the LEDs and a transparent cover, which, together with the housing or the carrier element, encloses the LEDs, and wherein the optical unit is an integral component of the cover and the cover is adhesively bonded to the housing or to the carrier element.

As a result of the adhesive bonding, according to the invention, of the cover to the housing or to the carrier element, the number of elements which are required to implement a closed lamp housing and to exert the necessary influence on the light output can be reduced to a minimum. In this case, the adhesive bonding between cover and housing or carrier element ensures that the remaining seam can be sealed off reliably. Only the access, preferably provided on the rear side of the lamp, for cabling for feeding the power supply must still be sealed off in a suitable way, wherein this region can be potted in a simple way with an appropriate material. This ensures that the lamp ultimately achieves the intended protection class IP65, therefore is designed to be watertight.

A second aspect of the present invention, as already mentioned, relates to the sealing of the lamp with respect to the profile element in which the lamp is to be arranged. To this end, an elongated installation opening, in which the lamp is inserted, is preferably provided in the profile element. The possibly desired sealing between lamp and profile element is achieved in this case, according to the invention, in that the cover has a preferably completely circumferential projection projecting laterally beyond the housing or the carrier element, which is provided to rest against the circumferential region of the mounting opening of the façade construction, wherein a seal is arranged on the side of the projecting projection that faces the housing or the carrier element. This seal therefore rests on the region of the profile element of the façade construction that surrounds the mounting opening and effects the necessary sealing between the two elements (lamp and profile element), so that it is ensured that no liquid can penetrate into the profile element via the mounting opening. It is preferably provided here that the seal is formed by an adhesive material. Firstly, in this way the sealing function is improved, secondly the seal can also be used simultaneously as a holder for the mechanical fixing of the lamp to the façade construction.

A second aspect of the present invention which, if appropriate, however, could also be combined with the aforementioned first aspect, accordingly proposes a lamp for arranging on a façade construction which comprises a pot-like housing or a carrier element, in or on which LEDs are arranged, wherein the lamp further has an optical unit assigned to the LEDs and a transparent cover, which, together with the housing or the carrier element, encloses the LEDs. According to the invention, the cover has a preferably completely circumferential projection projecting laterally beyond the housing, which is provided to rest against the circumferential region of the mounting opening of the façade construction, wherein a seal is arranged on the side of the projection that faces the housing.

To this extent, the aforementioned optical unit, which is preferably an integral component of the cover of the façade lamp, forms what is known as a primary optical unit for exerting an influence on the light output by the LEDs. It involves one or more lens-type optical elements which, seen in cross section, are formed approximately in the manner of a truncated cone and, on the side facing the LEDs, have a light entry surface formed by a recess. The light exit surface of the cover is formed on the opposite side. This can be formed as a flat surface or, if appropriate, can additionally be structured, in order then in this case to form a secondary optical unit. For this secondary optical unit, for example, prism-like structuring, grooving or the like would be conceivable. Here, the optical means for influencing the light output are preferably designed in such a way that a highly asymmetric output of light is achieved, that is to say the light illuminates an elongated region that is as narrow as possible on a surface to be illuminated. The aforementioned primary optical units can each be assigned individually to the LEDs or extend as a single element over a plurality of LEDs.

For the further fixing of the façade lamp according to the invention to a façade construction, additional fixing elements, in particular fixing springs, can furthermore be provided on the lamp housing or the cover. Following insertion of the lamp into the installation opening, the springs then press against the profile element from the rear side, so that, in addition to the adhesive bonding already mentioned and preferably used, secure retention is ensured via the circumferential seal.

Other developments of the invention relate in particular to measures by means of which it is ensured that overheating of the electronics of the lamp and of the light sources is avoided. Firstly, provision is made here for as much heat as possible to be led away efficiently via the housing, which, in particular, is made possible by the housing consisting of metal or the cover consisting of plastic being designed to be relatively long. In particular, the lamp is designed to be considerably longer than the arrangement of the LEDs provided therein, so that a large area is available for heat dissipation. Furthermore, a protective circuit is preferably provided for driving the LEDs, automatically reducing the power with which the LEDs are operated when the temperatures present on the LEDs reach a critical range. If necessary, the LEDs are at least temporarily also switched off completely in order to avoid thermal damage.

The invention is to be explained in more detail below by using the appended drawing, in which.

A preferred exemplary application for façade lamps, as already mentioned, consists in arranging such lamps in the region of a window soffit and then illuminating the opposite region and possibly also adjacent regions of the window soffit. In this way, the regions of the window of a building façade are highlighted visually.

Because of the space that is available, the lamps used should be configured very compactly and have a light emission characteristic with which the region of the façade to be illuminated is illuminated in an optimal way without relatively large proportions of the light being emitted in other regions. Desired in particular is a light distribution curve which exhibits high asymmetry, to the effect that the light is output along a first direction over a very large angular range but, on the other hand, in a second direction oriented perpendicular to the first direction, the light is output in a very limited way. The area of application also requires a construction to the effect that the lamp satisfies protection class IP65, that is to say is protected against the penetration of liquids. Furthermore, as far as possible, sealing between lamp and façade construction should be achieved, in order to prevent the penetration of liquids into the façade itself. The exemplary embodiments described below of lamps according to the invention have been optimized in view of the points mentioned above.

Figure 1:
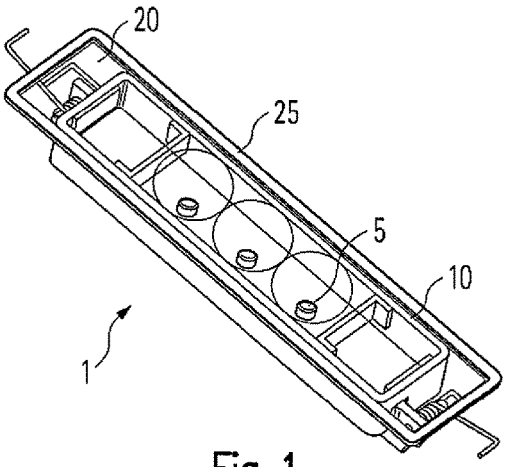
FIG. 1 shows a first exemplary embodiment of a façade lamp according to the invention in a perspective view.
Figure 2:
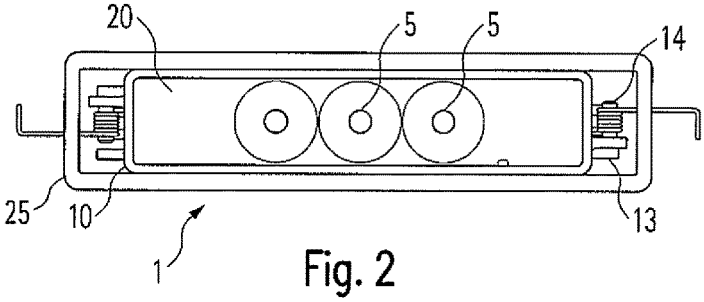
FIGS. 2 to 4 show further views of the façade lamp from FIG. 1.
Figure 3:
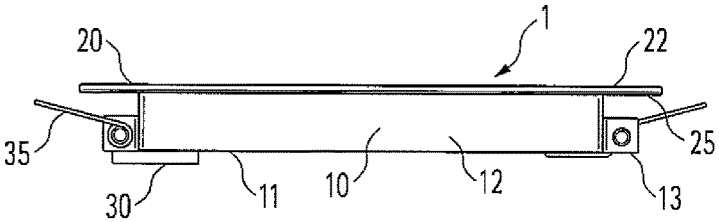

To this end, FIG. 1 shows, in a perspective view, a first exemplary embodiment of a façade lamp according to the invention, provided generally with the designation 1. As is also shown in the further FIGS. 2 to 6, in which the same elements of the lamp 1 are provided with the same designations, the lamp 1 comprises an elongated housing 10 which is closed on its upper side by a transparent cover 20. In the exemplary embodiment illustrated, the light sources provided are three LEDs 5, which are arranged on a common circuit board 6 (see the sectional illustrations of FIGS. 5 and 6). The circuit board 6 is also used at the same time to support electronic components, not specifically illustrated, for driving the LEDs 6, wherein these components in particular implement what is known as thermal feedback control. This means that the power of the LEDs 5 is automatically reduced when a sensor provided in the lamp 1 detects that the temperature reaches a critical value or range. This prevents the LEDs 5 being subjected to high temperatures and possibly being damaged in the process. The circuit board 6 according to the illustration of FIG. 5 is also located as flat as possible on the housing underside 11, so that the best possible thermal coupling between the two elements is present and, accordingly, the housing 10 can be used to discharge to the environment the heat occurring during the operation of the LEDs 5.

The housing 10 itself is elongated and configured approximately in the manner of a pot, wherein it can be seen that the housing 10 is considerably longer than the region over which the arrangement of the LEDs 5 extends. The bottom surface 11 and side walls 12 of the housing 10 accordingly form comparatively large surfaces, via which the heat can be discharged to the environment, so that there is no danger that the heat generated by the operation of the LEDs 5 on its own already leads to overheating. The housing 10 preferably consists of metal.

Figure 4:
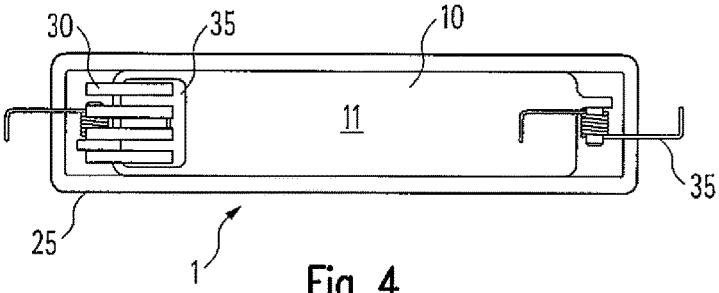

The power supply of the LEDs 5 and of the further electronic components of the lamp 1 is provided via cables 30, which are led into the interior of the housing 10 from the bottom surface 11. In order to achieve a watertight seal in this region, after the cables 30 have been led through, the corresponding region is potted with a sealing, curing material 35, as the view of the underside in FIG. 4 shows. The material 35 then effects an absolutely watertight configuration of the bottom surface of the lamp 1, so that here the requirements for achieving protection class IP65 are satisfied.

Figure 5:
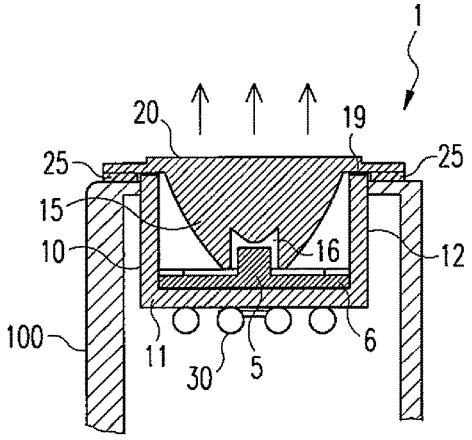
FIGS. 5 and 6 show two illustrations of the façade lamp illustrated in FIGS. 1 to 4 and arranged in the profile element of a façade construction.
Figure 6:
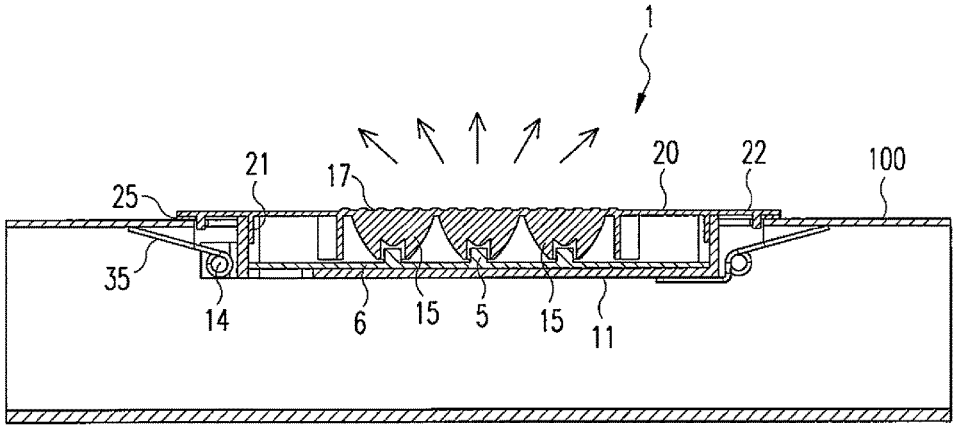
Figure 7:
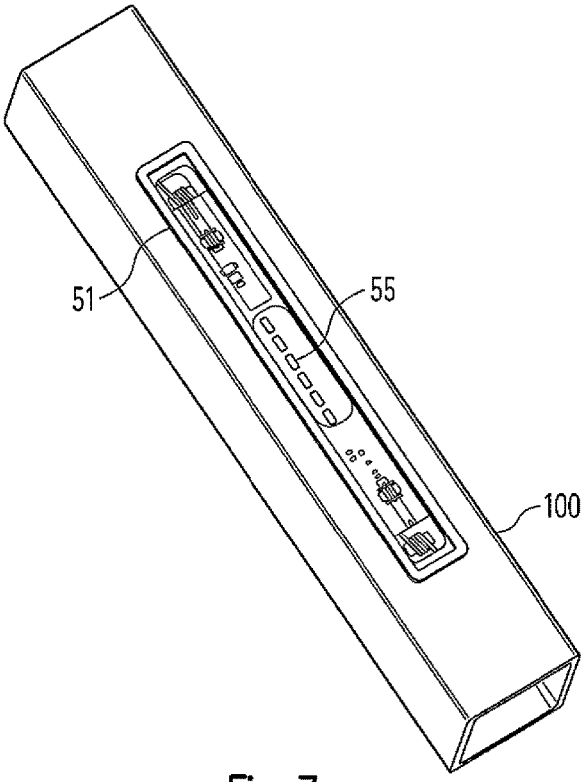
FIG. 7 shows a second exemplary embodiment of a façade lamp according to the invention and arranged in a profile element.
Figure 8:
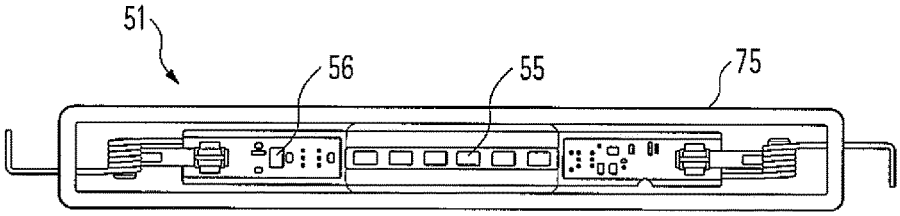
FIGS. 8 and 9 show further views of the façade lamp from FIG. 7, and FIGS. 10 and 11 show sectional illustrations of the arrangement of the façade lamp from FIG. 7 in the profile element.
Figure 9:
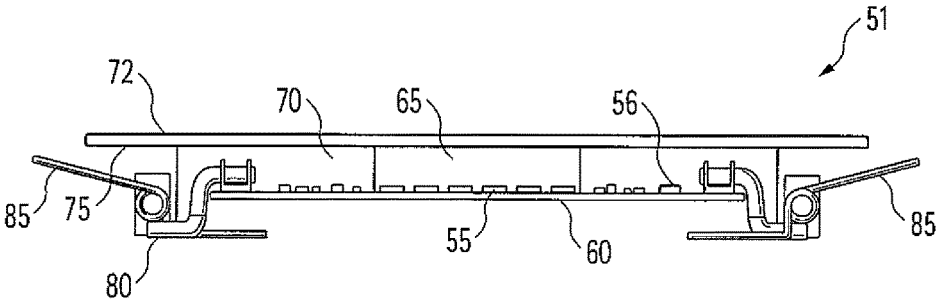
Figure 10:
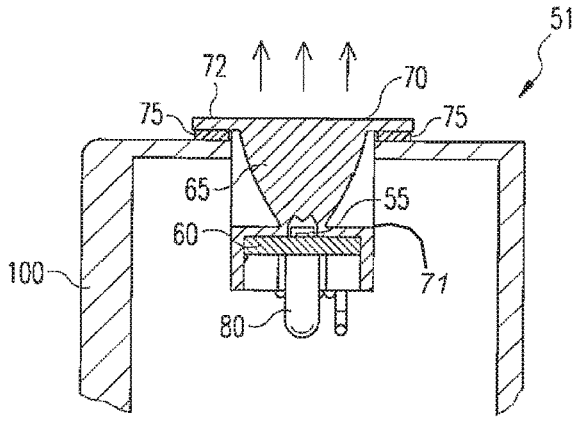

The light is output from the lamp 1 via optical elements, the configuration of which can be gathered in particular from the sectional illustrations of FIGS. 5 and 6. These are what are known as primary optical units in the form of truncated pyramidal lens elements 15, which each have a recess 16 facing the LEDs 5, into which the LED 5 projects slightly. The outer surface of this recess 16 and the curved bottom surface of the latter here forms the light entry region of the optical element 15, wherein, in a known way, the light beams which originate from the LED 5 and enter the element 15 are oriented by said element 15 in such a way that said light beams leave the latter substantially perpendicular to the plane of the cover 20. In a direction transverse with respect to the longitudinal direction of the lamp housing 10, the light is therefore output only in a very narrow beam (see FIG. 5). In the longitudinal direction, on the other hand, the light is intended to be output in a very wide angular range (see FIG. 6), which is achieved by the use of secondary optical units on the light exit surface of the cover 20. In the case illustrated, these secondary optical units are implemented by transverse grooves 17 or by prismatic structures oriented in the transverse direction, which distribute the emergent light beams over a wide range, so that ultimately, when the lamp 1 is arranged in the region of a window soffit, the surrounding region of the soffit can be illuminated completely despite the extremely compact dimensions of the lamp 1 (the latter has a length of only about 10 cm). Here, the area of the cover 20 via which light is output is preferably designed to be clear, whereas, on the other hand, the remaining area of the cover 20 is designed to be matt.

According to the invention, the optical elements are an integral component of the cover 20, therefore do not constitute separate elements which would have to be arranged in a separate manner in the lamp 1. As a result of the reduction obtained hereby in the components, it is ultimately achieved that all the relevant components of the lamp 1 that are to be protected are enclosed exclusively by the pot-like housing 10 and the cover 20. In order to be able to reach protection class IP65 for the lamp overall, it is therefore merely necessary for an appropriate seal to be achieved between these two elements.

According to the invention, this sealing of the lamp housing is achieved in that the cover 20 is adhesively bonded to the pot-like housing 10. The adhesive bonding 19 extends between the underside of the cover 20 and the upper edges of the front and side walls of the housing 10, wherein firstly a fixed connection and secondly a reliable seal are achieved by adhesively bonding over the entire circumference. By means of two webs 21, which project into the interior of the housing 10 and in particular rest on the inner sides of the front walls, a positioning aid is created here, so that as they are joined together, exact mutual alignment between housing 10 and cover 20 is ensured. Furthermore, the sealing is additionally improved in the area of the front walls of the lamp 1.

The watertight lamp 1 obtained in this way is then inserted into the elongated mounting opening of a profile element 100 of a façade construction and is fixed mechanically there. Here, first measures for holding the lamp 1 consist in two holding springs 35, which are arranged on the two ends of the lamp 1. The springs 35 are fixed to the housing 10 here via a pin-like projection 14, which is arranged on a tab 13 protruding from the front wall. Following the insertion of the lamp 1 into the profile element 100, the end regions of the springs 85 press against the wall of the profile element 100 from the underside. Since, at the same time, the cover 20 is dimensioned to be larger than the housing 10, said cover rests in the manner of a flange on the outer surface of the profile element 100, so that the lamp 1 is clamped securely to the profile element 100.

However, the fact that the cover 20 is designed to project circumferentially as compared with the housing can be used not only to clamp the lamp 1 to the profile element 100. Furthermore, additional sealing of the mounting opening can be achieved, which is attained by a supplementary measure which is to be described below.

For this purpose, provision is made that, on the projecting region 22 of the cover 20, on the underside of the latter, there is arranged a circumferential seal 25, which acts between the cover 20 and the region of the profile element 100 that surrounds the mounting opening. In this way, the result is the intended seal, which leads to no moisture being able to enter the profile element 100 via the mounting opening. Because of the fact that the seal 20 has a relatively widely projecting circumferential region 22, there is also a certain freedom with regard to the configuration of the mounting opening. Said opening therefore does not have to be matched exactly to the external dimensions of the housing 10, the desired sealing between lamp 1 and profile element 100 nevertheless being achieved.

Furthermore, provision is advantageously made for the seal 25 to be designed to be self-adhesive, firstly in view of the application to the cover 20 and secondly also with respect to the profile element 100. As a result of the adhesive properties, the seal is improved once more, but, moreover, the retention of the lamp 1 on the profile element 100 is also optimized. Since the lamp 1 itself has a relatively low weight, the adhesive bonding between cover 20 and profile element 100 would even be sufficient for adequate retention of the lamp 1 and it might be possible to dispense with the clamping springs 35.

Viewed overall, therefore, a lamp is obtained which, with regard to the dimensions thereof, the light emission characteristics thereof and the sealing thereof with respect to its surroundings, is optimally suitable for use as a façade lamp.

Figure 11:
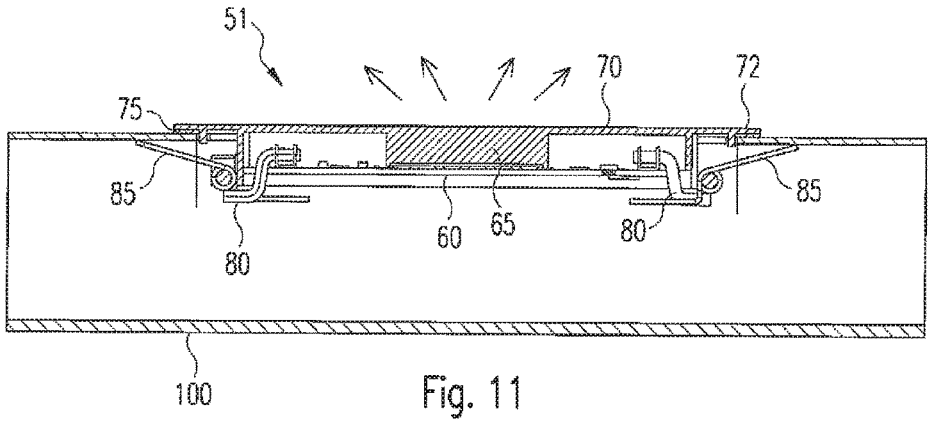

A second exemplary embodiment of a façade lamp according to the invention is illustrated in FIGS. 7 to 11. The special feature of this second embodiment consists in the fact that the façade lamp provided with the designation 51 does not have a dedicated housing or the housing is primarily formed by the cover 70. In particular, here the circuit board 60 on which the LEDs and corresponding electronic components 56 are arranged is coupled directly to the transparent cover 70. In the region of the LEDs the cover 70 once more integrally has an optical unit 65 for influencing the light output, wherein this optical unit 65, viewed in cross section, is once more designed in the manner of a truncated pyramid but now extends over the entire LED arrangement. The optical unit 65 therefore once more leads to focusing of the light in the transverse direction. However, the fact that said optical unit now extends over a longer dimension means that no focusing takes place in the longitudinal direction and the light beams—as illustrated in FIG. 11—are once more output as desired over a large angular range.

In the region on both sides of the LED arrangement, the cover 70 has side walls 71 which extend as far as the circuit board 60. If appropriate, this side wall can also extend over the entire length of the circuit board 60. In both cases, this means that the circuit board 60, together with the cover 70, once more encloses the LEDs 55 and the further electronic components 56 of the lamp 51. Since, at the same time, the circuit board, so to speak, forms the underside of the lamp housing, the heat produced during the LED operation can be led away efficiently via the same.

In this case, too, only two units are accordingly provided, overall surrounding the components to be protected against humidity, wherein provision is once more made for the circuit board 60 and the cover 70 to be adhesively bonded to each other in order to achieve the watertight configuration. The electric lines 80 are now fed in both end regions of the lamp 51, once more the appropriate openings for the cables to be led through being potted with a material that seals off in a watertight manner.

With regard to the further elements for arranging on the profile element 100, the second variant of the façade lamp corresponds to the embodiment illustrated in FIGS. 1 to 6. Once more, therefore, two holding springs 85 are arranged at the front ends of the lamp 51, the corresponding mounting for the springs 85 now being arranged on the transparent cover 70 that extends as far as the circuit board 60. The cover 70 itself once more has a circumferential overlap 72, on the underside of which the preferably adhesively designed seal 75 for sealing against the profile element 100 is arranged. Once more, therefore, the lamp 51 is itself designed to be watertight and, furthermore, is also configured in such a way that, when mounted, it seals off the mounting opening of the profile element 100 with respect to the exterior.

With respect to the self-adhesive seal, it should be noted that, to simplify the handling, the same is preferably provided with an easily detachable covering element, which is removed only before the immediate mounting of the lamp on the profile element. Since the seal extends over the entire circumference, that is to say is formed in the manner of a ring, at first glance a likewise annularly configured covering element would be suggested. However, in practice it has transpired that such an annular covering element can be removed only with difficulty. Preferably, therefore, two identically formed tear-off strips arranged offset by 180° relative to each other and having corresponding tabs, which can be removed considerably more simply, are provided. Of course, a comparable measure can also be provided in the first exemplary embodiment of FIGS. 1 to 6.

Viewed overall, in both cases a compact lamp is implemented which, with regard to the intended light output and the required protection class, satisfies all the requirements of a façade lamp.

The invention claimed is:

1. A lamp for arranging in a façade construction, comprising:

a housing formed by a circuit board and a transparent cover; and

LEDs and further electronic components for driving the LEDs, wherein the LEDs and further electronic components are arranged within the housing;

wherein the LEDs and further electronic components are arranged on the circuit board with the transparent cover integrally forming an optical unit aligned with the LEDs, the transparent cover being adhesively bonded to the circuit board enclosing the LEDs and further electronic components there between;

wherein the transparent cover has a completely circumferential projection projecting laterally beyond the circuit board to rest against a circumferential region of a mounting opening of the façade construction; and a seal is arranged on a side of the circumferential projection of the transparent cover that faces a façade construction.

2. The lamp as claimed in claim 1, wherein the seal is formed by an adhesive material.

3. The lamp as claimed in claim 1, wherein in cross section, the optical unit is formed in the shape of a truncated cone.

4. The lamp as claimed in claim 3, wherein each LED is assigned an optical element.

5. The lamp as claimed in claim 3, wherein an optical element extends over a plurality of LEDs.

6. The lamp as claimed in claim 1, wherein a secondary optical unit is formed on an outer side of the cover facing away from the carrier element.

7. The lamp as claimed in claim 1, wherein openings for feeding in lines for the power supply, located on the carrier element or the cover, are potted with a sealing material.

8. The lamp as claimed in claim 1, wherein said lamp has clamping springs, for clamping to a profile element of a façade structure.

9. The lamp as claimed in claim 1, wherein said lamp includes a protective circuit which, when a predefined temperature is exceeded, operates the LEDs with a lower output or deactivates the same.

10. The lamp as claimed in claim 1, wherein, the transparent cover further comprises outwardly projecting side walls which are bonded to the circuit board to enclose the LEDs.

* * * * *